US009007254B2

(12) United States Patent
Vangen et al.

(10) Patent No.: US 9,007,254 B2
(45) Date of Patent: Apr. 14, 2015

(54) ANTENNA BEAM CONTROL ELEMENTS, SYSTEMS, ARCHITECTURES, AND METHODS FOR RADAR, COMMUNICATIONS, AND OTHER APPLICATIONS

(75) Inventors: Knut Vangen, Oslo (NO); Jan Pleym, Oslo (NO)

(73) Assignee: Vestas Wind Systems, A/S, Aarhus N (DK)

( * ) Notice: Subject to any disclaimer, the term of this patent is extended or adjusted under 35 U.S.C. 154(b) by 240 days.

(21) Appl. No.: 13/520,949

(22) PCT Filed: Jan. 7, 2011

(86) PCT No.: PCT/US2011/020565

§ 371 (c)(1),
(2), (4) Date: Nov. 12, 2012

(87) PCT Pub. No.: WO2011/085237

PCT Pub. Date: Jul. 14, 2011

(65) Prior Publication Data

US 2013/0069813 A1 Mar. 21, 2013

Related U.S. Application Data

(60) Provisional application No. 61/293,620, filed on Jan. 8, 2010.

(51) Int. Cl.
*H01Q 17/00* (2006.01)
*H01Q 19/02* (2006.01)
(Continued)

(52) U.S. Cl.
CPC ..... *H01Q 17/00* (2013.01); *H01Q 19/021* (2013.01); *H01Q 19/104* (2013.01); *H01Q 21/20* (2013.01); *H01Q 19/10* (2013.01)

(58) Field of Classification Search
CPC ..... H01Q 17/00–17/008; H01Q 21/20; H01Q 19/021; H01Q 19/0104; H01Q 19/10
USPC ..... 342/1–12, 81, 157, 368–377
See application file for complete search history.

(56) References Cited

U.S. PATENT DOCUMENTS 2,691,102 A 10/1954 Masters
4,163,235 A * 7/1979 Schultz ..... 342/353
(Continued)

FOREIGN PATENT DOCUMENTS

EP 0730319 A1 9/1996
EP 1635187 A2 3/2006
EP 1689030 A1 8/2006

OTHER PUBLICATIONS

International Search Report and Written Opinion dated Apr. 15, 2011 for International Application No. PCT/US2011/020565.

*Primary Examiner* — John B Sotomayor
(74) *Attorney, Agent, or Firm* — Patterson & Sheridan, LLP

(57) ABSTRACT

The present invention provides, among other things, antenna beam control devices, systems, architectures, and methods for radar and other applications, such as wireless communications, etc., to improve transmit and/or receive performance of the devices and systems employing such antennas by deploying beam control elements (20) to increase antenna gain at an angle less than a first angle relative to the antenna gain at angle greater than a first angle. Beam control elements are deployed in combination with the one or more antennas (12) in various systems of the present invention, such that the impact of reflected radiation from wind mill, communication, or other towers supporting the system or other nearby structures, as well as radiation from nearby wireless communication networks is decreased to an acceptable level. The beam control elements can include absorbing and reflective material and can be placed in the antenna near field to minimize costs.

34 Claims, 13 Drawing Sheets

(51) Int. Cl.
*H01Q 19/10* (2006.01)
*H01Q 21/20* (2006.01)

(56) References Cited

U.S. PATENT DOCUMENTS

| | | | | |
|---|---|---|---|---|
| 4,327,364 | A * | 4/1982 | Moore | 342/1 |
| 5,337,066 | A | 8/1994 | Hirata et al. | |
| 5,436,630 | A * | 7/1995 | Nash | 342/2 |
| 5,525,988 | A * | 6/1996 | Perkins et al. | 342/4 |
| 6,115,003 | A * | 9/2000 | Kozakoff | 343/840 |
| 6,320,544 | B1 * | 11/2001 | Korisch et al. | 343/700 MS |
| 6,933,881 | B2 * | 8/2005 | Shinoda et al. | 342/70 |
| 6,992,643 | B2 * | 1/2006 | Fox et al. | 343/909 |
| 8,013,775 | B2 * | 9/2011 | Woods | 342/1 |
| 8,044,857 | B2 * | 10/2011 | Maenpa et al. | 342/368 |
| 8,077,104 | B1 * | 12/2011 | Fox et al. | 343/782 |
| 2002/0158801 | A1 | 10/2002 | Crilly et al. | |
| 2004/0252046 | A1 | 12/2004 | Mork et al. | |
| 2004/0257261 | A1 * | 12/2004 | Agler | 342/1 |
| 2005/0128134 | A1 * | 6/2005 | Shinoda et al. | 342/70 |
| 2005/0277441 | A1 * | 12/2005 | Lastinger et al. | 455/561 |
| 2007/0229390 | A1 * | 10/2007 | Fox et al. | 343/909 |
| 2007/0241962 | A1 * | 10/2007 | Shinoda et al. | 342/361 |
| 2008/0150827 | A1 * | 6/2008 | Lastinger et al. | 343/841 |
| 2009/0040127 | A1 * | 2/2009 | Williams | 343/841 |
| 2013/0069813 | A1 * | 3/2013 | Vangen et al. | 342/1 |
| 2014/0132449 | A1 * | 5/2014 | Roper | 342/368 |

* cited by examiner

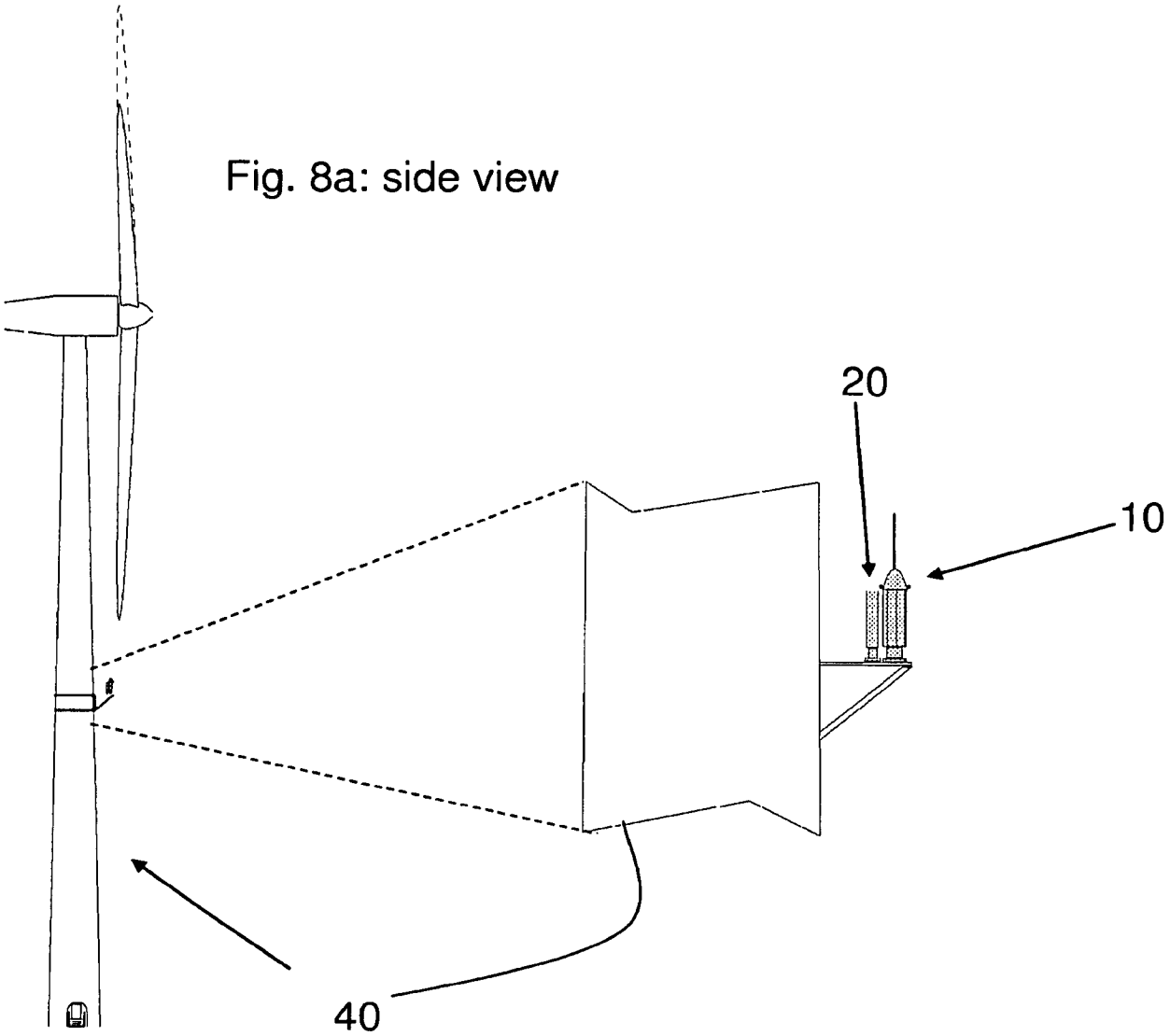
Fig. 8a: side view

Fig. 8b: top view
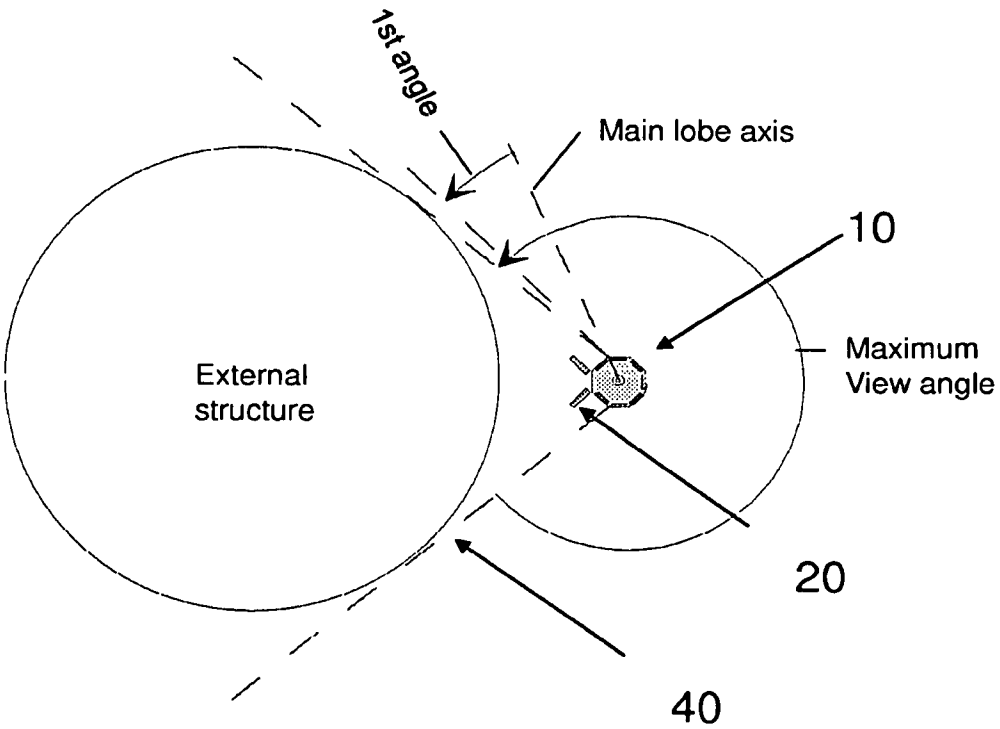

Fig. 9a – top view
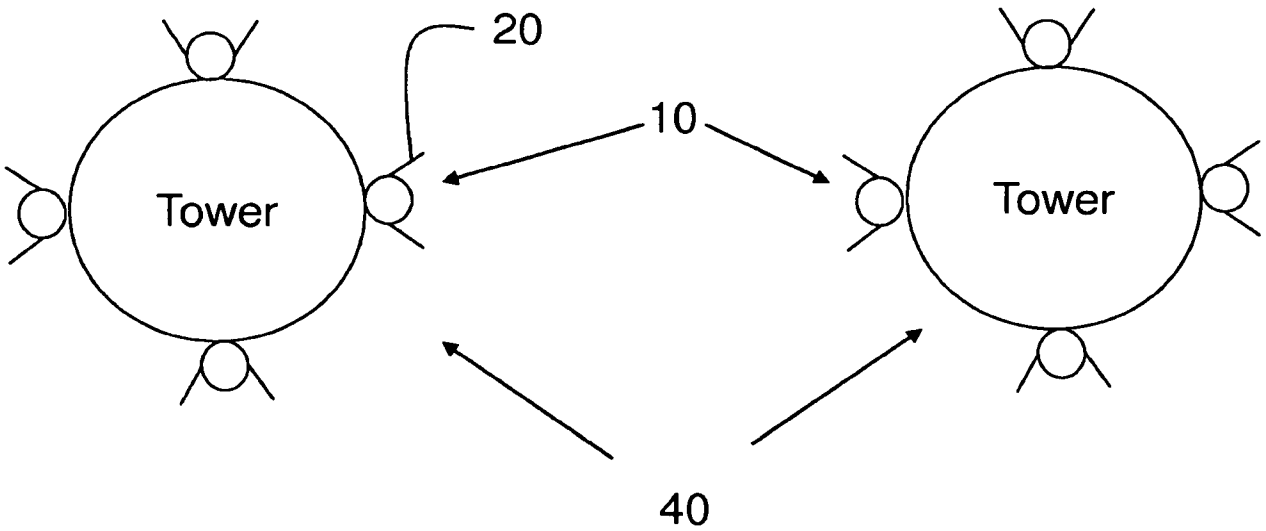

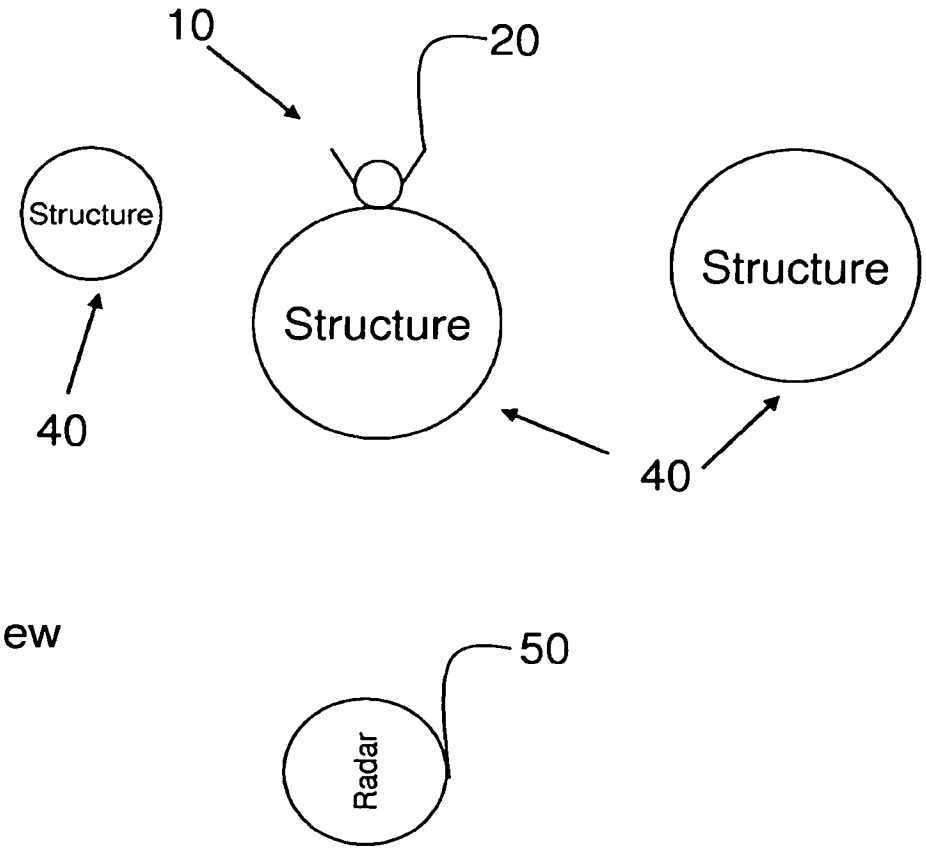
Fig. 9b – top view

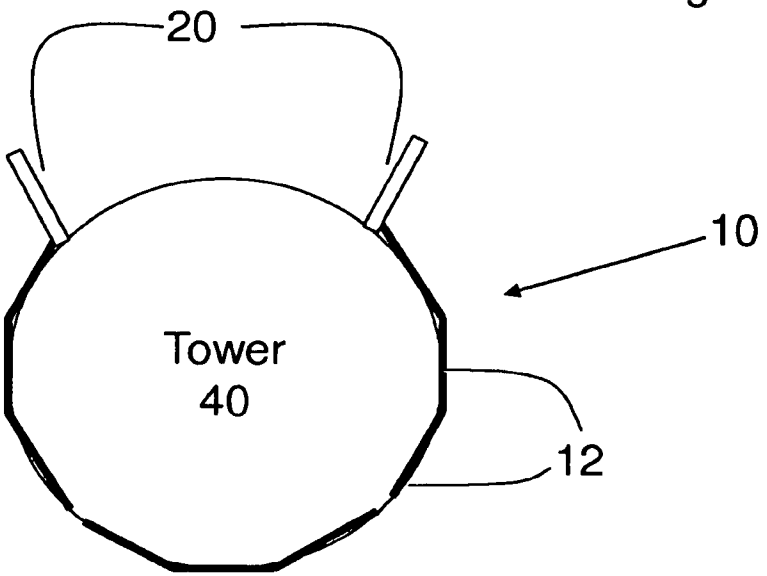
Fig. 10 – top view

ANTENNA BEAM CONTROL ELEMENTS, SYSTEMS, ARCHITECTURES, AND METHODS FOR RADAR, COMMUNICATIONS, AND OTHER APPLICATIONS

This application is a national stage entry of PCT/US2011/020565 filed on Jan. 7, 2011 which claims benefit of U.S. provisional application 61/293,620 filed on Jan. 8, 2010. Both applications are incorporated by reference in their entirety.

TECHNICAL FIELD

The present invention is directed generally to antenna beam controlling systems and, more specifically, to antenna beam control elements, systems, architectures, and methods for radar and other applications, such as communication systems, etc.

BACKGROUND ART

Radio transmitter and receiver antennas are frequently installed at the side of towers, such as telecom and wind turbine towers, and other physical structures, as well as in the vicinity of other systems employing radio transmitters and receivers. Antennas with wide azimuth coverage or that may scan a wide azimuth range may get the physical structure inside its radiation area, where the structure may disturb the antenna function. In addition, antenna arrays often generate a desired main lobe, but also side and back lobes which may reduce the effective gain and directivity of the total array and produce undesired reflections, thereby diminishing the performance of the system.

While the physical structure itself will limit the useable azimuth angle for the antenna, even for azimuth angles outside the physically blocked sector, part of the antenna beam may illuminate the physical structure, reducing accuracy by undesired reflections via the structure, or the structure can produce secondary reflections even when it is not illuminated. Also, the antenna beam must not be pointed such that multipath interference via the structure may disturb the system function. For the antenna to operate at azimuth angles close to the structure, a high gain antenna is required. For an antenna with steered beam, scan angles close to the structure may not be useable. For low gain arrays, the useable scan angle becomes strongly limited due to the wide lobe and possible side lobes. Adding RF absorbing material at the physical structure will reduce the problem. However, as the tower structure may be very large compared to the antenna itself, adding absorber material to the structure itself may be expensive or impractical.

In addition, the proximity of other systems employing radio transmitters and receivers, such as radar and communications system, can limit the usable angle and/or bandwidth of a system. The neighboring radio based systems combined with physical structure interference can severely limit the operational range of antenna-based systems.

Prior art solutions to the problem of obstructions typically involve the use of directional antennas or absorbers. Directional antennas, such as horns, often provide for higher gain, but limit the coverage area of the antenna, thereby requiring more antennas to provide coverage and increasing the cost. The increased number of antennas may also make installation and operation of the antennas more difficult, if the antennas have to be aligned more precisely. The use of absorbers, such as those described in U.S. Pat. No. 5,337,066, reduces the gain of the antenna, which, in turn, typically reduces the coverage distance of the antenna.

Improved antenna solutions are required that overcome the various limitations associated with prior art solutions to enable systems with improved performance and applications.

SUMMARY OF INVENTION

The present invention provides, among other things, antenna beam control elements, systems, architectures, and methods for radar and other applications, such as communication, to improve transmit and receive performance of the devices and systems employing such antennas. A method of managing the impact of radiation reflected or emanating from nearby structures, radars, and networks, on low or high gain antennas has been found by providing one or more beam control elements that can be placed in the antenna near field to increase the antenna gain and enhance radiation emitted or received by the antenna at an angle less than a first angle relative to the antenna gain and radiation emitted or received by the antenna at an angle greater than a first angle. In various embodiments, the antenna gain and peak intensity at an angle less than the first angle can be increased and the antenna gain and peak intensity at an angle greater than the first angle can be decreased relative to antenna gain in the absence of the beam control element.

The present invention provides, among other things, antenna beam control elements, systems, architectures, and methods for radar and other applications, such as communication, to improve transmit and receive performance of the devices and systems employing such antennas. A method of managing the impact of radiation reflected or emanating from nearby structures, radars, and networks, on low or high gain antennas has been found by providing one or more beam control elements that can be placed in the antenna near field to increase the antenna gain and enhance radiation emitted or received by the antenna at angle less than a first angle relative to the antenna gain and radiation emitted or received by the antenna at angle greater than a first angle. In various embodiments, the antenna gain and peak intensity at an angle less than the first angle can be increased and the antenna gain and peak intensity at an angle greater than the first angle can be decreased relative to antenna gain in the absence of the beam control element.

Beam control elements can be deployed in combination with the antennas in various systems of the present invention such that the impact of reflected radiation from wind mill, communication, or other towers supporting the system or other nearby structures, as well as radiation from nearby wireless communication networks can be decreased to an acceptable level. The amount of reflected radiation from structures and radiation from nearby networks that is acceptable may depend upon the particular application in which the inventive system is deployed. For example, radar and voice and data mobile phone applications may have differing requirements for signal to noise ratio, as well as other signal characteristics.

The beam control elements can include absorbing and reflective material that are used in combination to improve the gain of the antenna, while reducing undesirable radiation from being transmitted and received by the antenna. The beam control elements can be positioned proximate to the antenna to be comparable in size with the antenna itself, which is beneficial from a cost and installation perspective. One of ordinary skill will appreciate that the impact of the beam control element on the signal/radiation pattern/antenna performance will be influenced by its location in the near field.

The applicable antenna may consist of one basic antenna element or 2 or more basic antenna elements in an array in horizontal (azimuth) and vertical (elevation) axes. The use of the present beam control element allows a wide antenna beam to be used, which is desirable for cost reasons, because the number of antenna elements can be reduced. The inventive wide area antenna with the beam control element with improved performance also provide additional margin in the installation and use of the antenna, because of increased coverage area and distance. In addition to fixed systems, the inventive beam control element is compatible with phase controlled antenna elements, which allows beam steering to be used, for example in electronically scanning radar applications, etc.

In this and other manners, the present invention addresses limitations of the prior art as will become further apparent from the specification and drawings.

BRIEF DESCRIPTION OF DRAWINGS

The accompanying drawings are included for the purpose of exemplary illustration of various aspects of the present invention, and not for purposes of limiting the invention, wherein.

It will be appreciated that the implementations, features, etc. described with respect to embodiments in specific figures may be implemented with respect to other embodiments in other figures, unless expressly stated, or otherwise not possible.

DESCRIPTION OF EMBODIMENTS

Figure 1:
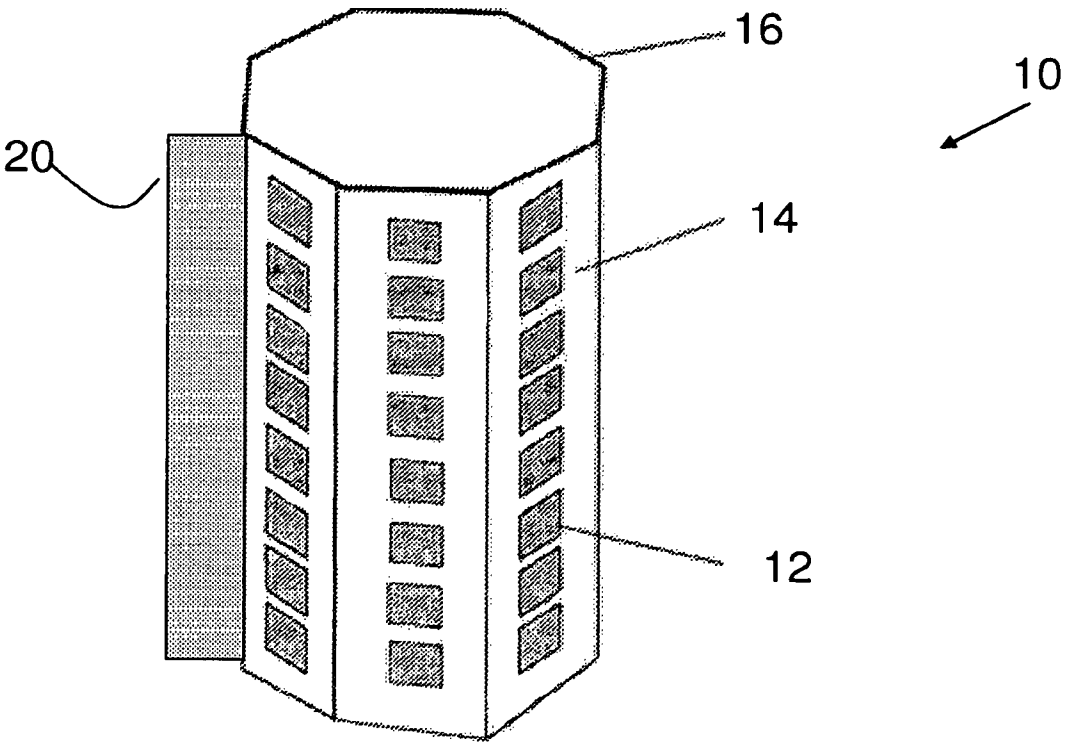
FIG. 1 shows embodiments of an antenna system with at least one beam control element.

FIG. 1 depicts an exemplary system 10 including an antenna having one or more antenna elements 12 that can be arranged in an array in horizontal (azimuth) and/or vertical (elevation) axes, as well as other configurations as desired. For example, the elements in the embodiment illustrated in FIG. 1 are arranged in arrays supported by a panel 14, which are further connected via a frame 16 to form a deployable field unit. The system 10 includes at least one beam control element 20 that is positioned in accordance with the present invention and the application proximate the antenna 12 at a first angle, so as to attenuate radiation emitted from or approaching the antenna at angle greater than the first angle relative to radiation emitted from or approaching the antenna at angle less than the first angle.

It will be appreciated that the impact of the beam control element 20 can be described in terms of signals, or more generally radiation, passing through the antenna, or alternatively by the antenna performance, e.g., gain. For example, beam control element 20 can increase the antenna gain thereby enhancing the signal or radiation by increasing the intensity, total power in the main lobe, and/or the main lobe shape. Conversely, reducing the antenna gain produces attenuated signals/radiation. In addition, radiation and signals can be used interchangeably in various applications. Examples may focus on one description to facilitate the description of the invention, but unless otherwise noted are not intended to limit the invention.

The beam control element 20 can be implemented in a variety of systems 10, such as radar systems including those described in U.S. Pat. No. 7,136,011, which is incorporated by reference, communication systems, etc. It should be noted that a beam control element 20 according to the invention may be part of a system 10 including a single antenna element, an array of elements, or even several arrays operating in an array of arrays. Unless otherwise noted, a reference to antenna element or array 12 hereinbelow is intended to cover any and all of these alternative configurations, and reference numeral 12 may refer to a single element or to a plurality of elements in an array or a plurality of arrays connected to the same transmitter.

Similarly, antenna will be used as a general term referring to any configuration of one or more antenna elements.

The beam control element 20 can include at least a partially reflective material positioned to reflect side lobe radiation in the direction of main lobe radiation. For example, the beam control element 20 can be configured to reflect and attenuate side lobe radiation emitted from the antenna at an angle that is greater than the first angle in the direction of main lobe radiation that is emitted from the antenna at an angle less than the first angle.

The beam control element 20 can be configured to attenuate to varying degrees signals, or radiation more generally, approaching and emitted from the antenna at an angle that is greater than the first angle. For example, if a reflective material is used, it can be configured to strongly reduce the signal power, or radiation intensity at the antenna at angles greater than the first angle by effectively reducing the antenna gain depending upon the amount of attenuating material used in combination with the reflective material. At the same time, the reflective material can be used to increase the antenna gain to enhance the radiation, i.e., increase the intensity or peak power, at angles less than the first angle to varying extents depending upon the amount of attenuating material used in combination with the reflective material.

In various embodiments, the beam control element 20 can be configured to minimize the impact on the antenna gain and the resulting signal or radiation characteristics at less than the first angle. For example, it may be desirable to limit the impact of the beam control element 20 on the main lobe, while modifying the side lobes. In other embodiments, it may be desirable to narrow or widen the main lobe, as well as control the maximum intensity of the signal/radiation or peak gain of the antenna.

Beam control element 20 can be positioned proximate one or more antenna depending upon the application. For example, the beam control element 20 can be symmetrically designed and positioned between two or more transmitter/receiver antenna elements, so as to impact the elements in a similar manner. In other embodiments or applications, asymmetric designs may be more useful depending upon the antenna design and position of the beam control element. In various embodiments, the beam control element 20 can be positioned proximate an antenna array at a first angle relative to the array and configured to reduce the antenna gain to attenuate signals approaching the array at an angle that is greater than the first angle and increase the antenna gain to enhance at least one signal emitted from the multiple antennas at an angle less than the first angle by reflecting radiation from angles greater than the first angle.

Figure 2:
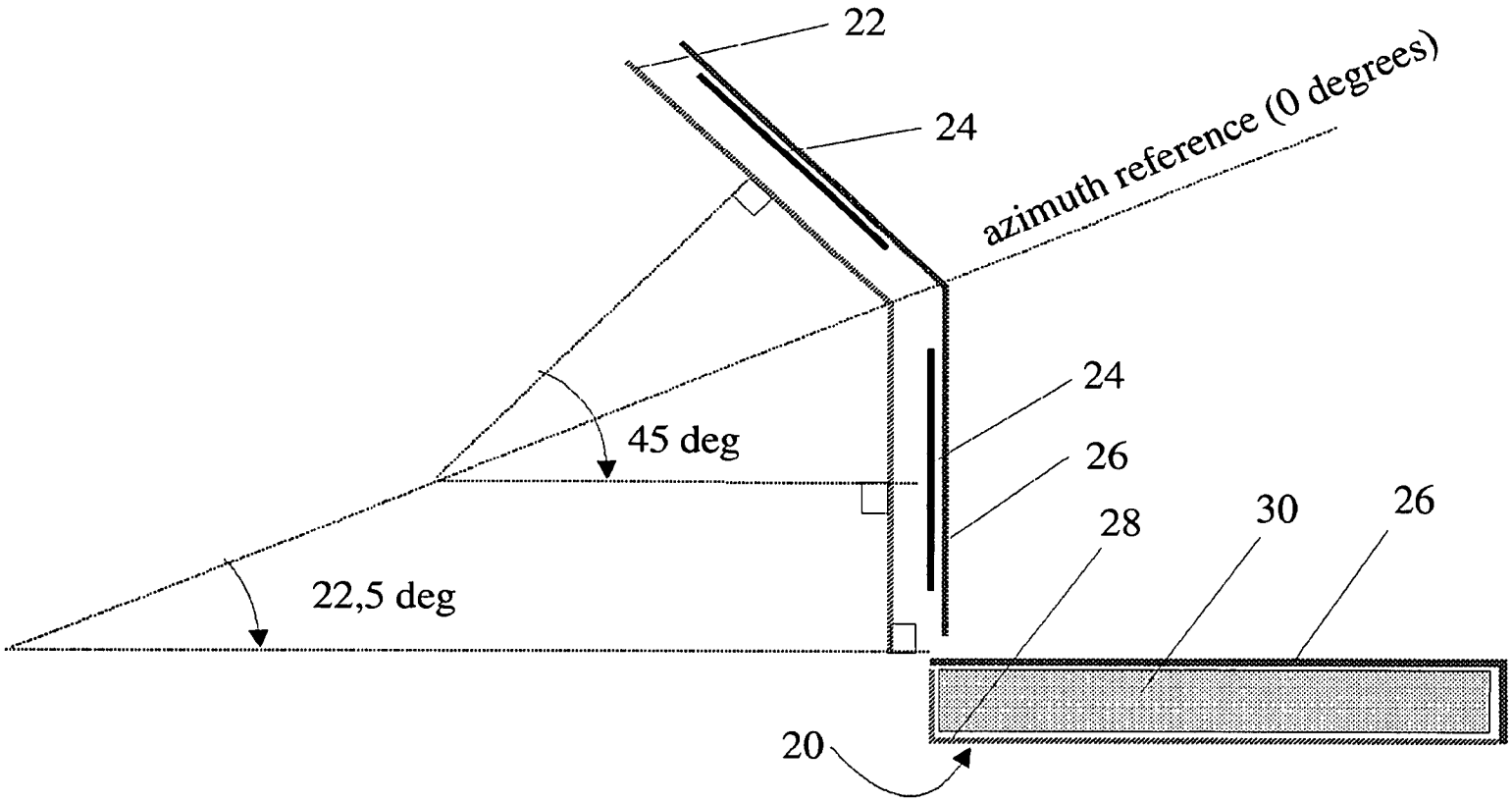
FIG. 2 shows embodiments of at least a portion of an antenna system with reference axis of radiation and beam control element.

FIG. 2 shows a portion of a horizontal cross section of the system 10 of FIG. 1, with vertical polarization-H plane is paper plane. A single antenna element 12 can include a ground plane 22, the patch element 24 (electrical feed not shown), and a radome 26. The radome 26 and the ground plane 22 may extend over several patch elements 24. It will be obvious to a person skilled in the art that this beam control element is not limited to this array geometry, polarization and basic antenna element type, and is applicable for single or double sided use with any single element and/or array and basic antenna element type. The beam control element 20 can include a shielding plate 28, absorber material 30, and radome 26. It will be appreciated that the radomes 26 may be integrated, as can ground planes 22. In these exemplary embodiments, two elements 12 adjacent to each other in the horizontal direction have a nominal azimuth radiation reference axis between the two elements, and horizontally radiation may be steered close to 22.5 degrees from the axis by phase shifting signals to the two elements. If several elements are arranged adjacently in the vertical direction (perpendicular to the paper plane of FIG. 2), as shown in FIG. 1, the radiation from the antenna may also be steered in the vertical direction.

The selection of the first angle can be influenced by a number of system design and operational objectives. For example, the first angle may depend upon the geometry of the system and the number of antenna elements being employed in each unit and the number of systems being deployed in a network. The design and material composition of the beam control element will generally be a consideration in the selection of the first angle.

Figure 3A:
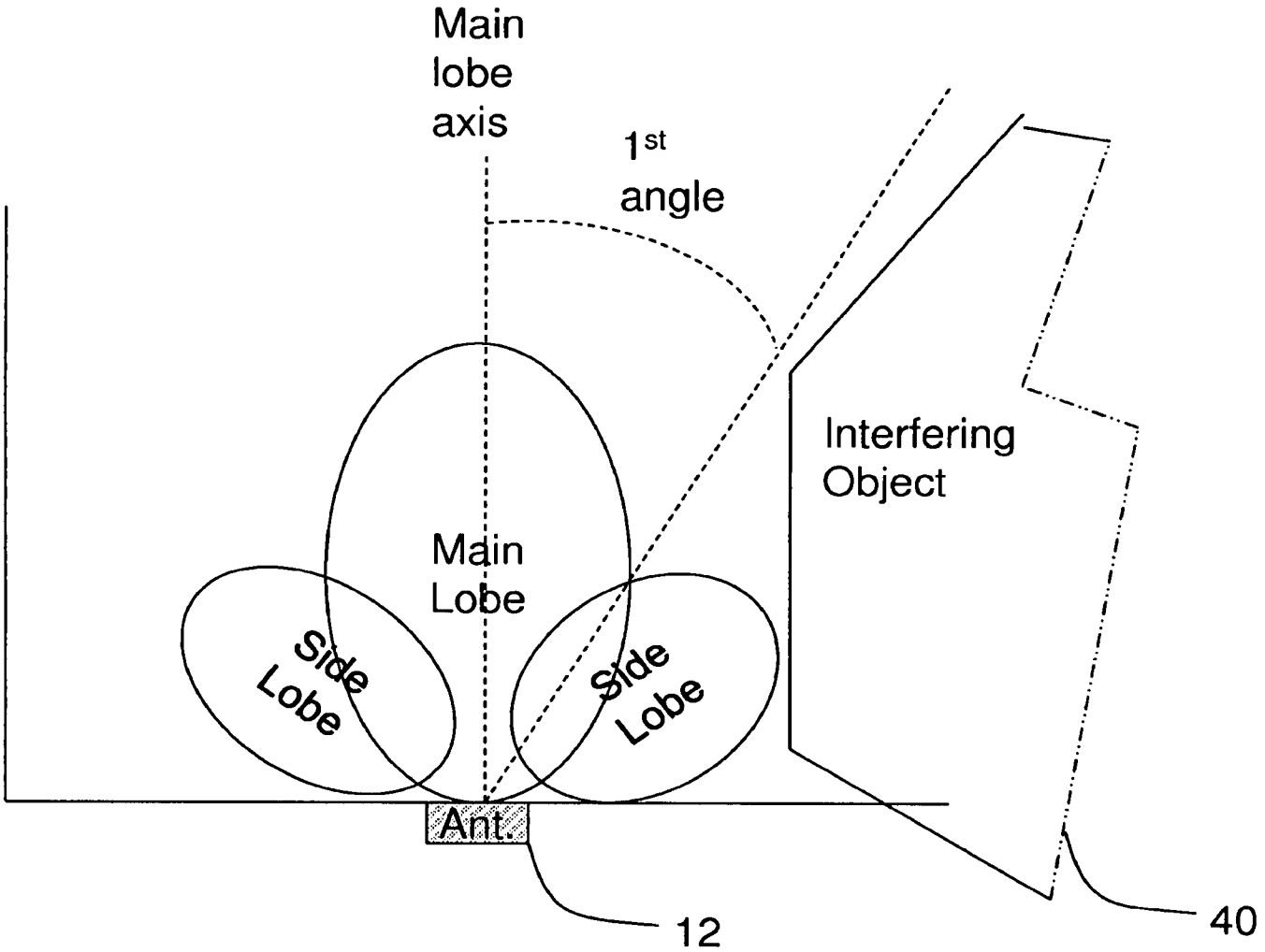
FIG. 3*a* & *b* show depictions of the selection of a first angle and placement of a beam control element relative to an antenna element, idealized main and side lobes, and a structure.

FIG. 3*a* depicts the main and side lobes of radiation being emitted from an antenna element 12 in the presence of an interfering object, such as a structure, 40 that could cause undesired reflections of the radiation back to the antenna. The first angle can be chosen relative to the main lobe axis of the antenna or antenna array to exclude the structure 40 from the radiation field of the antenna element or array 12. It should be noted that in the absence of any steering of the main lobe axis by phase shifting, the main lobe axis of FIG. 3*a* corresponds to the nominal azimuth radiation reference axis of FIG. 2.

Figure 3B:
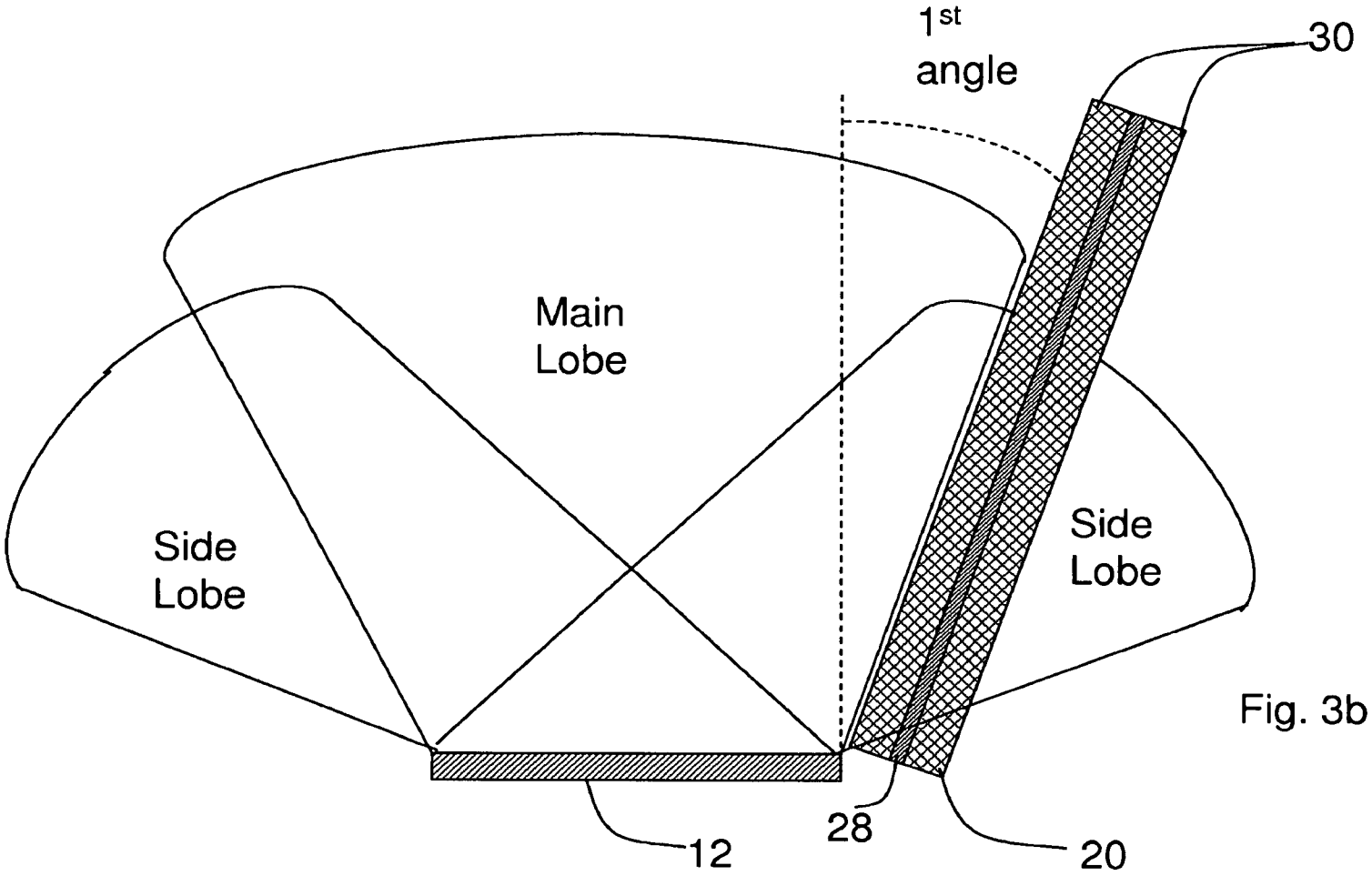

FIG. 3*b* shows the placement of the beam control element 20 at the first angle, so as to strongly reduce the resultant gain of the antenna element 12 at angles towards the structure 40. This configuration reduces the radiation into, as well as reflections from, the structure 40. Whether the beam control element 20 reduces gain at all angles or a gives combination of reduced gain at angles greater than a given angle and increased gain at angles less than the same angle may depend on the magnitude of the first angle and the characteristics of the beam control element 20. In the case of an interfering object 40 and the antenna used for radar application, transmission via object 40 may create separate mirror images of the observed object at false angles or the mirror image may mix with the direct radiated reflections from the observed object to reduce the angular accuracy of the radar.

Depending upon the system objectives, adversely impacting the radiation is attenuating the radiation to an extent that the system performance is degraded beyond operational requirements. In other words, the radiation emitted from the antenna at an angle less than the first angle can be modified without substantially diminishing it. In general, the first angle is selected such that the side lobes are attenuated as much as possible without adversely impacting the gain of the main lobe. In various embodiments, the beam control element configuration is balanced to enhance at least a portion of the radiation, i.e., main lobe, peak intensity, etc., while diminishing radiation in the side lobes. In other words, increasing the antenna gain relative to the main lobe, while reducing the antenna gain relative to the side lobes.

In various embodiments, the beam control element 20 is a layered combination of reflective and absorptive material. The reflective material being employed to substantially block the radiation, i.e., signals, approaching the antenna from angles greater than the first angle from reaching the antenna. The reflective material can also serve to reflect radiation emitted by the antenna at angles greater than the first angle in the direction of radiation emitted by the antenna at angles less than the first angle. The beam control element 20 can be configured such that reflected radiation emitted by the antenna could enhance the radiation level at angles less than the first angle. Exemplary reflective materials are generally materials that tend not to absorb significantly and to be opaque to radiation at the frequency of interest. For example, aluminum is an effective reflective material for radar applications. It will be appreciated that materials employed in various embodiments can range from partially reflective to fully reflective depending upon the application.

The absorptive material is provided to attenuate radiation approaching or emitted from the antenna at angles greater than the first angle. The amount of absorptive material used and its configuration in the beam control element depends upon the desirable beam shape of the radiation. For example, if a sharp beam shape for the main lobe of the radiation is desired or potential interference from reflected or nearby radiation sources may pose a problem, then the absorptive material would be increased accordingly. Conversely, if it is desirable to detect reflected radiation and there are not other nearby interference sources, then a lesser amount of absorptive material can be used. Exemplary absorber materials include commercially available RF absorber material, such as those sold by ETS-Lindgren and ECCOSORB® AN from Emerson & Cuming. The thickness/amount of absorber material will depend upon the frequency of interest and the desired amount of attenuation in the application. For example, in a radar application at 1.3 GHz, absorber thicknesses on the order of 25 mm can provide significant side and back lobe and wide angle attenuation, while still allowing main lobe beam sharpening via the reflective material.

The physical shape of the beam control elements can be varied depending upon the system requirements. For example, if the beam control element 20 is to be positioned between two antennas, then it may be desirable for the element to be symmetrically shaped, if a similar impact is desired for both antennas. If the element will be positioned with antennas on only one side, then each side of the element can be configured to achieve its specific objective. For example, the side of the element opposite the side of an antenna may best serve its intended function with a different shape and material. In planar beam control element 20 embodiments, the absorber material is layered on one or both sides of a reflective layer depending upon the application.

The beam control elements 20 can be located in various positions relative to the antenna element. In many applications, the beam control element 20 will be located only along a portion of the perimeter of the antenna. The beam control element 20 is particularly useful when there is a reflective body within the radiative or receiving range of the antenna or another antenna operating in a manner that would interfere with the proper function of the system. The beam control element 20 is positioned along the perimeter of the antenna element at a first angle such that reflections of radiation from the reflective body are not received or radiation is not transmitted to or received from a source/sink to be excluded. While beam control elements 20 could be deployed around the entire perimeter of the antenna, it would increase the cost of the system without necessarily providing an associated benefit. In fact, it may be desirable to not include beam control elements 20 except along specific portions of the perimeter, because the beam control element could limit the performance of the antenna in portions where they are not necessary.

In many instances, it is desirable to have a system that provides 360 degree coverage area. However, in some applications it may be desirable to eliminate antennas from the system that point generally toward a known reflective body or another system that could interfere with the performance of the system. Elimination of the antennas 12 pointing toward reflective bodies can improve the overall system performance, because secondary reflections from the known body that reach other antennas are eliminated.

In many applications, the beam control elements will only be deployed along the perimeter of the antenna elements where there is a known reflective body 40 that could interfere with the performance of the system, such as the detection of targets within the coverage area of a radar. In an exemplary radar application, the radar is placed in close proximity to a tower, or other obstacle, to detect targets that are approaching the tower. In these examples, it may be desirable to not place antennas in locations where the antennas 12 would emit radiation directly toward the tower 40. Beam control elements 12 would be deployed proximate antennas that might otherwise receive radiation directly reflected from the tower 40, as in FIG. 8*b* discussed below.

In many embodiments, the beam control element will be electrically decoupled from the antenna, so its impact is on the radiation. In other embodiments, it may be beneficial to couple the antenna and the beam control element to achieve an operational objective. Also, the beam control element 20 can be placed between antenna 12 to minimize and possibly eliminate mutual coupling of the antenna 12.

Figure 4:
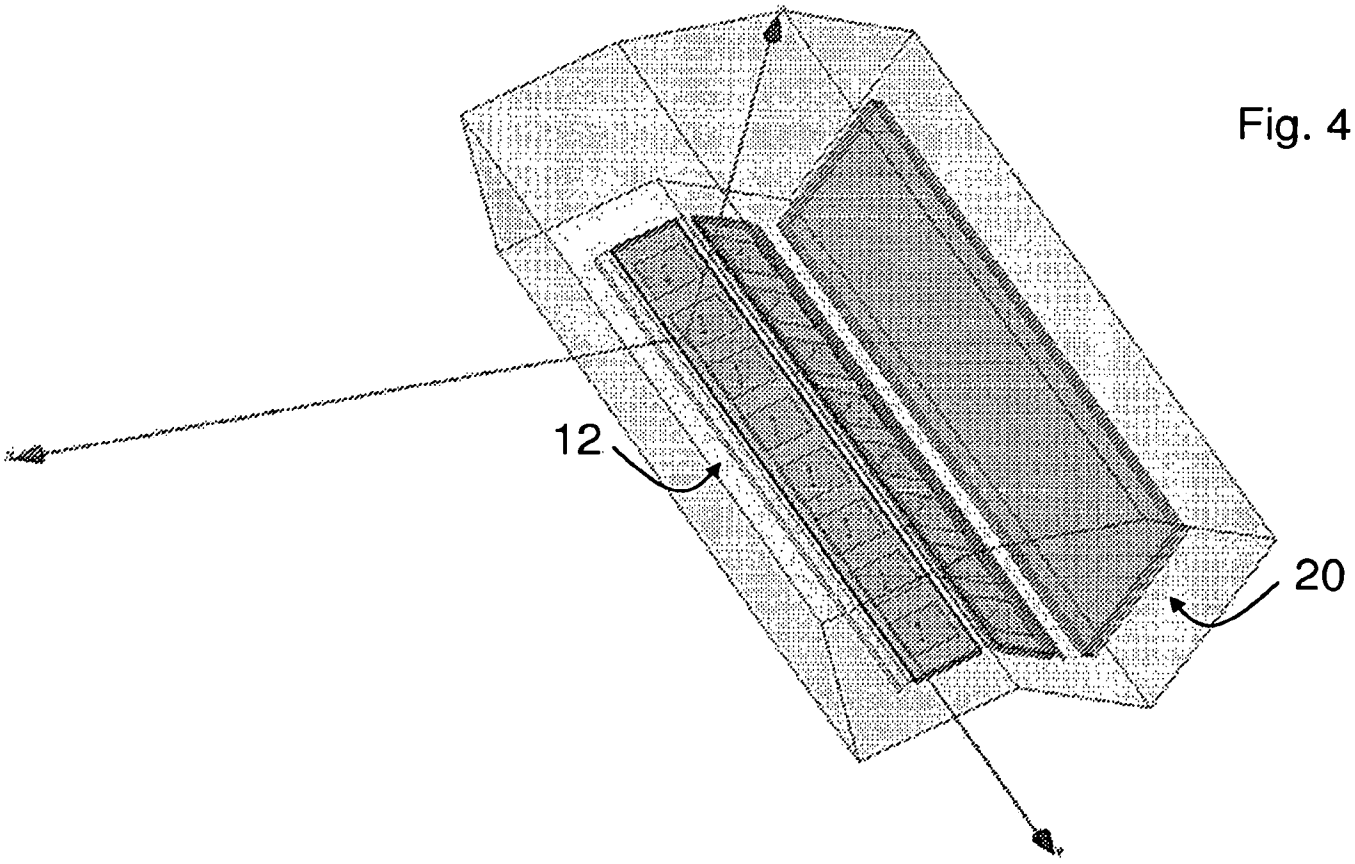
FIG. 4 shows 2×8 array embodiments from the back side with Z axis being the reference azimuth beam angle.

FIG. 4 shows a 2×8 array from the back side with the Z axis being the reference azimuth beam angle used for verification. It will be obvious to a person skilled in the art that the invention is not limited to this specific array or type of antenna element, and not limited to this specific geometry.

Figure 5:
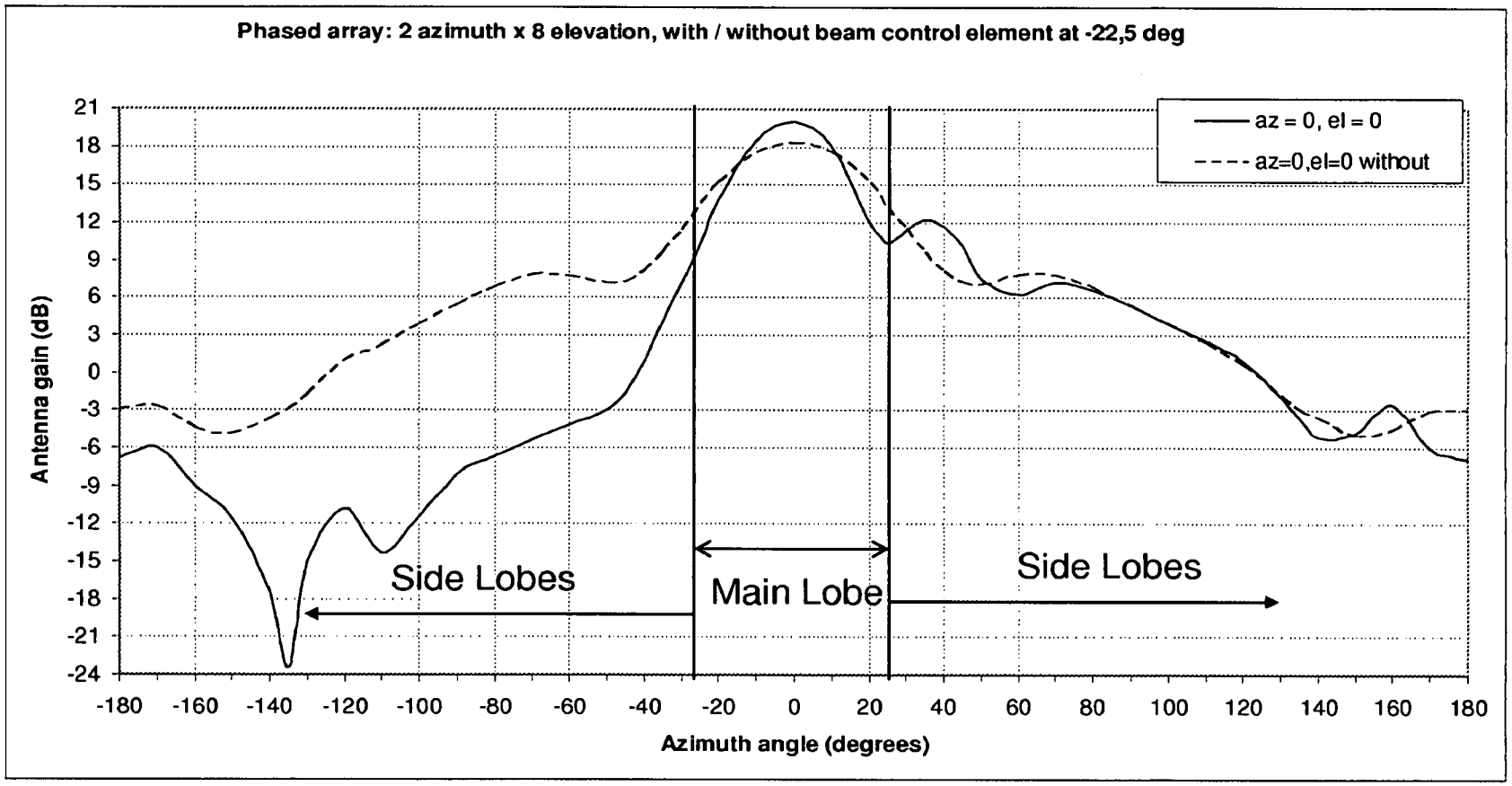
FIGS. 5-7 show various simulation and test results of antenna gain vs. azimuth angle with and without the beam control element of the present invention, FIGS. 8*a* & *b* show depictions of the placement of the antenna system in a wind mill application, FIGS. 9*a* & *b* show embodiments of the present invention used in communication and radar applications, and, FIG. 10 shows alternative embodiments for deployment in various applications from a top view.

FIG. 5 shows the antenna gain as a function of azimuth angle with and without the beam control element 20. No phase steering is applied and the beam is pointed in z axis from FIGS. 2 and 4. Overlaid on the graph showing the data without the beam control element 20 (dotted line) are lines showing the approximate demarcation of the main lobe and side lobes. As can be seen in the graph, from the angle of the beam control element, which in this example is positioned at −22.5 degrees, the added attenuation is approx. 4 dB (one-way), rising to 13 dB at −45 degrees, 22.5 degrees beyond the beam control element 20. As also seen, the side lobe is attenuated by 16 dB at −70 degrees. Tests results shown are at 1325 MHz, but similar results apply from 1307 to 1342 MHz. In addition, the beam control element enhances the maximum gain in the main lobe relative to operation without the beam control element. As can be seen, the beam control element 20, while not completely eliminating the side lobes, does substantially block the side lobes attenuating the signals, or reducing the antenna gain, in excess of 90%.

Figure 6:
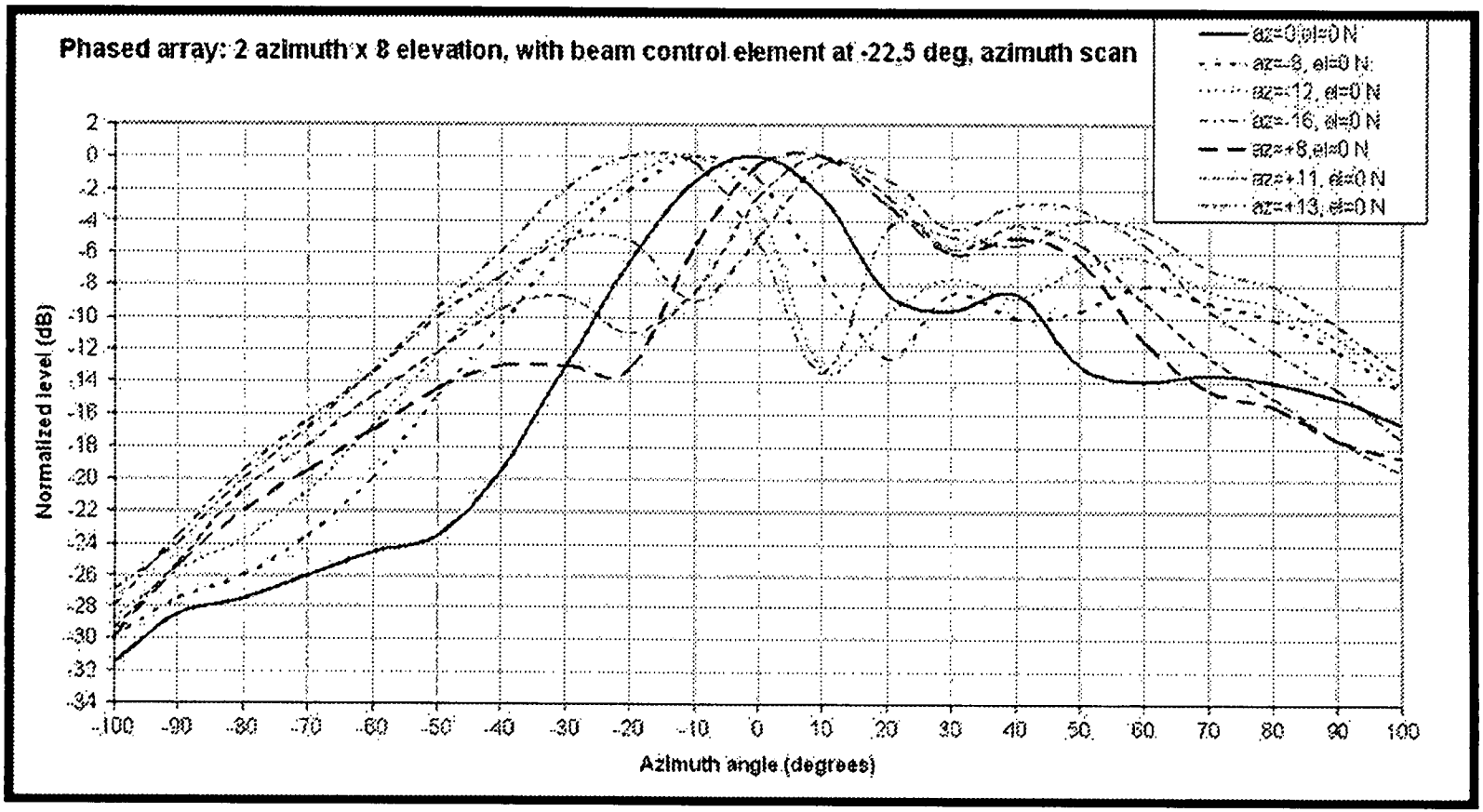

FIG. 6 shows results using an azimuth beam with one beam control element 20 positioned at −22.5 degrees relative to the nominal azimuth radiation reference axis and for various steered angles. FIG. 6 also shows antenna gain when the beam is steered towards and away from the beam control element. Side lobes are completely attenuated when steering the beam towards the beam control element. Side lobes reappear when steering away from the beam control element, but is attenuated compared to the corresponding side lobes without the beam control element.

Figure 7:
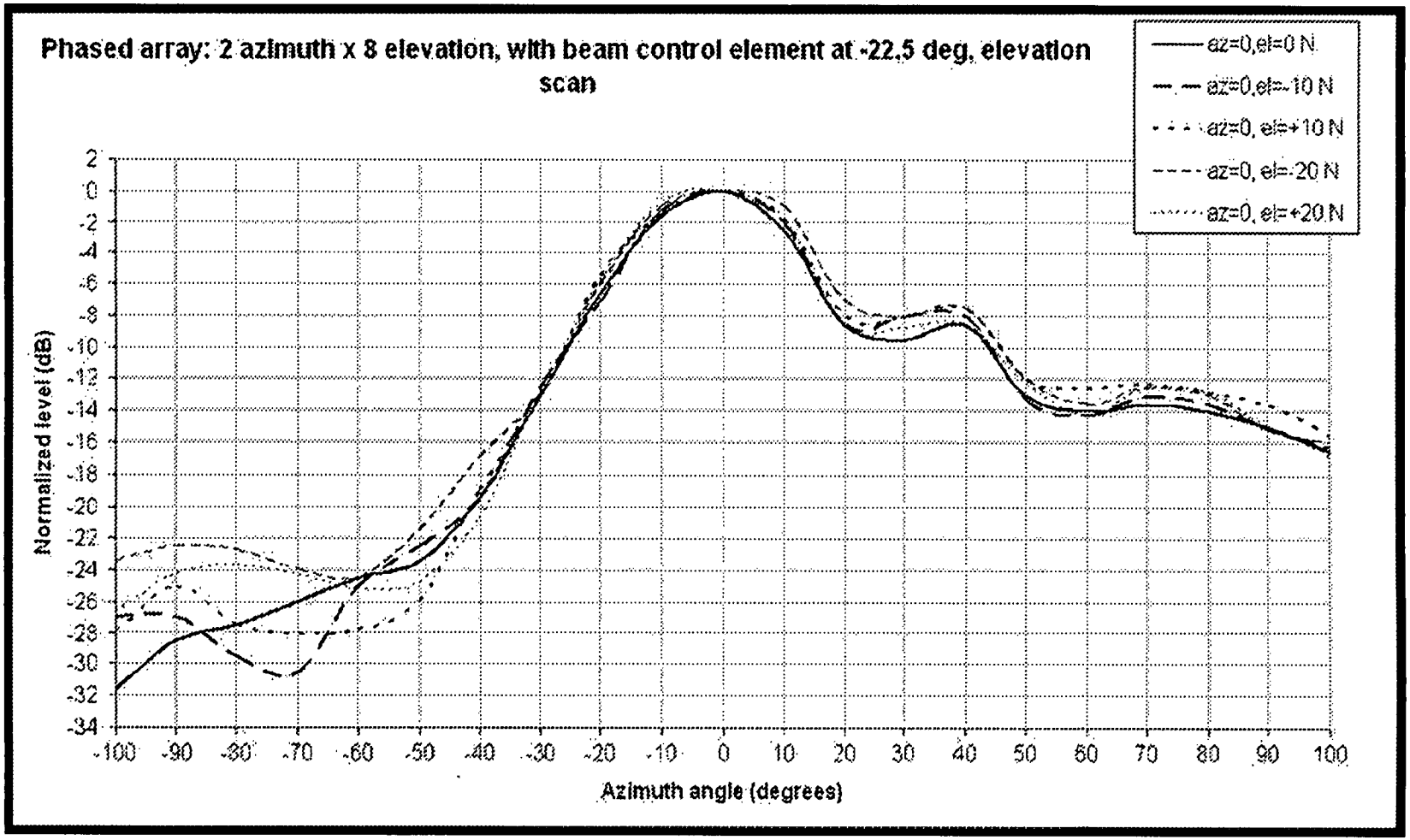

FIG. 7 shows that the elevation (perpendicular, E field axis, Azimuth beam at 0 degrees, elevation beam steered) is almost unaffected by the beam control element, when deployed in an array.

While the beam control element can be configured in many ways in the present invention, it is often desirable to have a number of the following properties:

- Preferably passive, such as a combination of absorbing and reflective (shielding) materials. Simple mechanical construction of sandwich for low cost manufacturing.
- Positioned in the antenna near field where a small size, weight and cost is possible rather than covering larger structures with absorbers or reflective elements
- Positioned outside the antenna main lobe, for minimum main lobe loss and attenuation of desired signals and inside the antenna side lobe, maximising the side and back lobe attenuation.
- Suitable for reduction and practical radiation cut-off towards external structures that would otherwise block or distort signal and create undesired reflections and to reduce antenna radiation to near zero at a well defined radiation angle.
- Robust to various steered main beam angles in a phased array antenna, where the lobe may be steered both in the axis of the absorber element and in the perpendicular axis or only one of the said axes. The distortion of the beam in the perpendicular axis is negligible. The distortion of the beam in the axis of the beam control element is well controlled even when the main beam is steered close to the angle of the beam control element.
- Predictable effect on the antenna beam, which may predictably be compensated in subsequent signal processing, i.e., good correspondence between 3D electromagnetic simulation and measurements.
- Well controlled and predictable radiation patterns even with beam steering in both axes allow high accuracy radar performance even at scan angles close to a physical structure where accuracy would otherwise be compromised when using low gain antennas.
- Allows operation at scan angles close to undesired objects as towers and buildings, insensitive to changes in the undesired object to be masked.
- Increases the effective main lobe gain towards the side of the beam control element. The increased gain is comparable to using a higher order antenna array. As example, an array of 2 with the beam control element performs comparable to an array of 4 elements at the side of the lobe control element.

In various embodiments, the beam control elements are configured to allow two or more antennas to have overlapping coverage areas, while still performing the task of attenuating and enhancing the various signals. In other embodiments, the beam control elements will be configured to minimize or eliminate overlap between antenna coverage areas. The skilled artisan will appreciate the trade-offs with overlapping providing a continuous coverage area and non-overlapping allowing the reuse of spectrum, etc. for multiple antenna. For example, in radar applications it may be desirable to provide overlapping coverage area to ensure that targets that are being detected by the radar can be continuously tracked within the coverage area. In communications application, it may not be desirable to have overlapping ranges, if the same frequency spectrum is going to be used.

The present invention can be employed in a number of applications including radar antennas, cellular network base station antennas, limiting undesired (culprit) antenna side lobe radiation for various technical reasons or public health reasons, reducing interference sensitivity from the side lobes of the (victim) antenna, etc.

FIGS. 8*a* & *b* show embodiments (not necessarily to scale) of the system 10 deployed proximate the structure 40. In these embodiments, antenna elements 12 can be provided azimuthally and/or vertically to provide a substantially continuous coverage area in the azimuthal plane. It will be appreciated that antenna elements will usually not be deployed in the direction of the structure(s) 40 to reduce cost and/or control performance. In the present invention, one or more beam control elements 20 can be deployed to prevent reflections from the structure 40 from being received by the antenna elements 12. While FIG. 8*a* & *b* shows only one structure 40, it will be appreciated that many structures 40 can be in a potential coverage area for the system 10, such as in a windmill park, and the azimuthal coverage angle of the system 10 and the number and design of beam control elements 20 can be varied to accommodate the particular deployment.

In radar antenna embodiments, the system 10 may be installed at towers and buildings where these structures 40 will partially block the angle of view, and may generate undesired signal paths that reduce radar angle measurement accuracy, as described above. The beam control element 20 assures a predictable cutoff of radiation into the external structure 40, allowing good accuracy at steered beam azimuth angles less than 5 degrees from the beam control element. In these embodiments, it may be desirable to provide less than 360 coverage due to the proximity of the physical structure 40. As such, not only will beam control element 20 be used to substantially block radiation from being transmitted toward or reflected by the structure 40, but the system 10 can be configured to exclude antenna elements 12 or scans in the direction of the physical structure 40, as shown in the figures.

FIG. 9*a* depicts communication tower embodiments, such as for cellular network base station antennas and other wireless communication systems, in which multiple systems 10 are positioned proximate the structure 40. The basic antennas are normally arrays with high elevation gain and low azimuth gain, where the azimuth side and back lobes may radiate well into neighbour and next-neighbour cells such that these cells must be separated in frequency, code or time to prevent interference. In these applications, the beam control element 12 can improve the isolation between each cell in the azimuth axis, allowing increased re-use of frequency, code or time slots at the base station, in addition to preventing interference from the structure. Reuse in communication applications can provide a significant benefit in that reuse effectively increases the available bandwidth of the station.

FIG. 9*b* depicts embodiments of the invention, in which the system 10 can be used as a gap filler, or shadow, radar system for use in areas where a primary radar 50 can not provide adequate coverage of the area for any number of reasons including the presence of structures, e.g., buildings, and restrictions on the use of radar near installations and facilities. In these embodiments, the beam control element would help decrease reflections from the primary radar that reach the antenna 12. One of ordinary skill will appreciate that the system 10 and radar 50 may need to operate at different frequencies and orientations to ensure the effectiveness of the system 10 in providing radar coverage in areas not adequately covered by the primary radar 50.

FIG. 10 shows embodiment in which the antenna elements 12 of the system 10 are deployed surrounding and/or integrated with the one of the structures 40. While FIG. 10 embodiments show antenna elements 12 deployed only partly around the perimeter of the structure 40 and in combination with beam control elements, it will be appreciated that number and angular extent of antenna elements 12 and beam control elements 20 positioned around the structure 40 can be varied by the skilled artisan to specific deployments and applications. It will be further appreciated that other parts of the system 10, which could include central processing units, communication equipment, etc. can be deployed proximate the antenna elements 12 on the structure 40 or not proximate to the antenna elements 12, for example on the ground or proximate another access point to the structure 40.

These and other variations, modifications, and applications of the present invention are possible and contemplated, and it is intended that the foregoing specification and the following claims cover such variations, modifications, and applications.

What is claimed is:

1. An apparatus comprising:

at least one antenna, the antenna being a phased array where the antenna is configured to steer the radiation both azimuthally and by elevation; and, a beam control element positioned along a perimeter of the at least one antenna at a first azimuth angle offset from an azimuth reference axis perpendicular to a plane of a surface of the antenna that emits radiation such that the beam control element is positioned outside a main lobe of the antenna and between at least a portion of a side lobe of the antenna and the main lobe, the beam control element comprising:

a reflective material; and an absorptive material positioned between the antenna and the reflective material configured to attenuate signals emitted or received by the antenna at a second azimuth angle that is greater than the first azimuth angle relative to at least one signal emitted or received by the antenna at a third azimuth angle less than the first angle.

2. The apparatus according to claim 1, wherein the beam control element is positioned to reflect side lobe radiation in the direction of main lobe radiation.

3. The apparatus according to claim 1, wherein the beam control element is configured to reflect side lobe radiation emitted by the antenna at the second azimuth angle in the direction of main lobe radiation emitted from the antenna at the third azimuth angle.

4. The apparatus according to claim 1, wherein the beam control element is configured to reduce a gain of the antenna in a direction of azimuth angles that are greater than the first azimuth angle.

5. The apparatus according to claim 4, wherein the beam control element is configured to block signals approaching the antenna at the second azimuth angle.

6. The apparatus according to claim 1, wherein the at least one antenna is configured to emit and receive radar signals.

7. The apparatus according to claim 1, wherein the at least one antenna is one of a plurality of antennas configured in an array.

8. The apparatus according to claim 7, wherein the array is an electronically scanning array.

9. The apparatus according to claim 1, wherein signals emitted by the antenna in a direction less than the first azimuth angle are not attenuated by the beam control element.

10. The apparatus according to claim 7, wherein the beam control element is positioned at a first planar angle relative to a surface of the array that emits radiation and configured to attenuate signals approaching the array at an angle that is less than the first planar angle and enhance at least one signal emitted from the array at an angle greater than the first angle.

11. The apparatus according to claim 1, wherein the beam control element is positioned between the at least one antenna and another antenna.

12. The apparatus according to claim 1, wherein the beam control element is not electrically coupled to the antenna.

13. The apparatus according to claim 1, wherein the antenna is configured to receive and emit communication signals.

14. A method of controlling radiation reflected from a structure toward an antenna comprising:

providing a first antenna;

providing a beam control element comprising a reflective material and an absorptive material; and, positioning the beam control element along a first azimuth angle between a reference azimuth vector perpendicular to a surface of the antenna that emits radiation and a second azimuth angle that defines a direction from the first antenna to the structure such that the beam control element is positioned outside a main lobe of the first antenna and between at least a portion of a side lobe of the first antenna and the main lobe, wherein the absorptive material is positioned between the antenna and the reflective material, thereby attenuating radiation approaching the antenna at the second azimuth angle relative to radiation approaching the antenna at an angle less than the first azimuth angle.

15. An apparatus comprising:

a plurality of antennas configured in an array to at least one of emit and receive signals; and at least one beam control element positioned between at least two of the plurality of antennas at a first azimuth angle offset from an azimuth reference vector perpendicular to a plane of a surface of one of the plurality of antennas such that the beam control element is positioned outside a main lobe of one of the at least two antennas and between at least a portion of a side lobe of the one of the at least two antennas and the main lobe, the beam control element comprising a reflective material and an absorptive material, wherein the reflective material is configured to attenuate signals emitted or received by the one of the at least two antennas at an angle that is greater than the first azimuth angle and enhance at least one signal emitted or received from the one of the at least two antennas at an angle less than the first azimuth angle.

16. An apparatus comprising:

a plurality of antennas configured in an array; and at least one beam control element positioned along a perimeter of a first antenna of the plurality of antennas at a first azimuth angle offset from an azimuth reference vector perpendicular to a plane of a surface of the first antenna such that the beam control element is positioned outside a main lobe of the antenna and between at least a portion of a side lobe of the antenna and the main lobe, the beam control element comprising a reflective material and an absorptive material positioned between the first antenna and the reflective material configured to attenuate signals emitted or received by the first antenna at an angle that is greater than the first azimuth angle and enhance at least one signal emitted from the first antenna at an angle less than the first azimuth angle.

17. The apparatus according to claim 16, wherein at least two of the plurality of antennas are configured in the array to at least one of emit and receive signals in different directions.

18. The apparatus according to claim 16, wherein at least two of the plurality of antennas are configured in the array to at least one of emit and receive signals in parallel directions.

19. The apparatus according to one of claim 16, wherein the beam control element is further configured to allow overlapping coverage areas between two adjacent antennas.

20. The apparatus according to claim 16, wherein the beam control element is further configured to prevent overlapping coverage areas between two adjacent antennas.

21. An apparatus comprising:

an antenna configured to at least one of emit and receive radiation; and a beam control element positioned along the perimeter of the antenna at a first azimuth angle offset from an azimuth reference vector perpendicular to a plane of a surface of the antenna that emits radiation such that the beam control element is positioned outside a main lobe of the antenna and between at least a portion of a side lobe of the antenna and the main lobe, the beam control element comprising:

a reflective material; and an absorptive material positioned between the antenna and the reflective material configured to attenuate radiation emitted or received by the antenna at an angle that is greater than the first azimuth angle without substantially diminishing radiation emitted or received by the antenna at an angle less than the first azimuth angle.

22. The apparatus according to claim 21, wherein the main lobe has a shape, magnitude, and overall power, wherein the beam control element is configured to modify the shape without substantially attenuating the overall power of the main lobe.

23. The apparatus according to claim 21, wherein the main lobe has a shape, magnitude, and overall power, wherein the beam control element is configured to modify the shape and increase the magnitude of the main lobe.

24. The apparatus according to claim 21, wherein the main lobe has a shape, magnitude, and overall power, wherein the beam control element is configured to attenuate the at least one side lobe.

25. The apparatus according to claim 24, the beam control element is configured to attenuate the side lobe at angles greater than the first azimuth angle and reflect at least a portion of the power from the side lobe into the main lobe.

26. A system comprising:

a radar field unit configured to be supported by a structure comprising:

an antenna comprising a plurality of antenna elements, wherein the antenna elements are disposed azimuthally around the radar field unit to provide a coverage area in at least a portion of an azimuthal plane, wherein the antenna is a phased array where the radiation from the antenna may be steered both azimuthally and by elevation, and at least one a beam control element disposed between at least two of the plurality of antenna elements, the beam control element is positioned along a perimeter of the antenna at a first azimuth angle relative to an azimuth reference axis perpendicular to a surface of the antenna that emits radiation, the beam control element comprising:

a reflective material; and an absorptive material positioned between the antenna and the reflective material configured to attenuate radiation approaching the antenna from the structure and radiation emitted by the antenna toward the structure.

27. The system according to claim 26, wherein the structure is one of a wind turbine and a communications tower.

28. The system according to claim 26, wherein the radar field unit is arranged to detect targets that are approaching the tower using the azimuthal coverage area.

29. The system of claim 26, wherein the antenna excludes any antenna elements that would emit radiation in the direction of the structure.

30. The system of claim 26, wherein the beam control element is planar.

31. The system of claim 26, wherein the radar field unit is an electronically scanning radar system, the antenna elements being phase controlled antenna elements configured for beam steering.

32. The system of claim 26, wherein the beam control element is attached to the field unit and extends in a direction away from field unit.

33. The system of claim 26, wherein the reflective material is aluminum.

34. The system of claim 26, wherein the absorptive material is a radio frequency absorber material.

* * * * *